US005892421A

United States Patent [19]

Matsushima

[11] Patent Number: 5,892,421

[45] Date of Patent: Apr. 6, 1999

[54] STARTER ACTIVATABLE AT LOW AND HIGH SPEEDS SEQUENTIALLY

[75] Inventor: Keiichi Matsushima, Toyota, Japan

[73] Assignee: Denso Corporation, Kariya, Japan

[21] Appl. No.: 783,799

[22] Filed: Jan. 15, 1997

[30] Foreign Application Priority Data

Jan. 16, 1996 [JP] Japan ..... 8-004480

[51] Int. Cl.[6] ..... H01H 67/02

[52] U.S. Cl. ..... 335/126; 335/131; 74/6; 74/7 R; 74/7 A; 74/7 C; 290/38 R; 290/48; 310/112; 310/184; 310/83

[58] Field of Search ..... 335/126, 131; 74/6, 7 R, 7 A, 7 C; 290/38 R, 48; 310/83, 112, 184

[56] References Cited

U.S. PATENT DOCUMENTS

| | | | |
|---|---|---|---|
| 2,542,712 | 2/1951 | Schneider et al. . | |
| 4,551,630 | 11/1985 | Stahura et al. | 290/38 R |
| 4,755,689 | 7/1988 | Porter | 290/38 R |
| 5,443,553 | 8/1995 | Shiga et al. | 74/7 R |
| 5,525,947 | 6/1996 | Shiga et al. | 335/126 |
| 5,600,184 | 2/1997 | Shiga et al. | 290/38 R |

FOREIGN PATENT DOCUMENTS

| | | |
|---|---|---|
| 56-72256 | 6/1981 | Japan . |
| 4-303521 | 10/1992 | Japan . |

*Primary Examiner*—Michael L. Gellner
*Assistant Examiner*—Tuyen T. Nguyen
*Attorney, Agent, or Firm*—Pillsbury Madison & Sutro LLP

[57] ABSTRACT

A rotation restricting member made of a resilient body such as a leaf spring is driven by a magnet switch upon energization of a motor and engages engaging grooves formed on an outer peripheral surface of an outer portion of a one-way clutch so that the rotation restricting member restricts rotation of the one-way clutch. The motor has first and second field coils connected in parallel. The first field coil is connected to an exciting coil in the magnet switch in series and the second field coil is connected to a motor contact in the magnet switch in series. When a starter switch is actuated, only the first field coil is actuated first with low voltage. Then, the motor contact is closed and the second field coil is actuated also so that the motor rotates at a high speed with full voltage.

8 Claims, 3 Drawing Sheets

STARTER ACTIVATABLE AT LOW AND HIGH SPEEDS SEQUENTIALLY

CROSS REFERENCE TO RELATED APPLICATION

This application is based on and claims priority of Japanese Patent Application No. 8-4480 filed on Jan. 16, 1996, the contents of which are incorporated herein by reference.

BACKGROUND OF THE INVENTION

1. Field of the Invention

The present invention relates to a starter for starting an internal combustion engine of a vehicle.

2. Description of Related Art

It is proposed in U.S. application Ser. No. 08/392,269 filed on Feb. 22, 1995 to activate a motor in two stages, i.e., at two speeds to engage a pinion with a ring gear smoothly. For example, the motor is activated in two stages by connecting a resistor to an electric current circuit of the motor, actuating the motor through the resistor with a voltage lower than a rated voltage until the pinion engages the ring gear. The motor is actuated with the rated voltage by shorting the resistor after the pinion engages the ring gear.

In the above-described method, other than a motor contact (a primary fixed contact and a primary movable contact) disposed in the electric current circuit, an auxiliary fixed contact connected to the primary fixed contact through the resistor and an auxiliary movable contact corresponding to the auxiliary fixed contact are disposed so that the auxiliary movable contact, together with the primary movable contact, moves with a plunger of a magnet switch. The auxiliary movable contact needs to contact the auxiliary fixed contact before the primary movable contact contacts the primary fixed contact. Therefore, for connecting the resistor to the electric current circuit, more component parts are required resulting in a complicated structure and reduced reliability.

SUMMARY OF THE INVENTION

In view of the foregoing problems, it is a primary object of the present invention to provide a starter for activating a motor in two stages or at two speeds in a simple structure without reducing reliability thereof.

According to the present invention, a starter includes first and second field coils connected in parallel. An electric current circuit has a first current path through which electric current flows to an armature via an exciting coil of a magnet switch and the first field coil, and also a second current path through which electric current flows to the armature via the second field coil when the motor contact is closed. Only the first field coil is energized to rotate the motor at a low speed due to low magnetomotive force of the first field coil, until a pinion moves a predetermined distance to engage an engine ring gear. Further, after the pinion engages the ring gear by moving the predetermined distance to drive the ring gear assuredly, the motor contact is closed by the magnet switch and the second field coil is also energized so that full magnetomotive force is generated to rotate the motor at a high speed. Thus, since the motor can be activated in two stages or speeds with a simple structure without using a resistor, reliability of the starter is enhanced.

Preferably, the exciting coil is constructed by using a part of a conductor of the first field coil, no additional conductors need be used separately from the field coil conductors, thus reducing manufacturing cost.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

The preferred embodiments of the present invention are hereinafter described with reference to the accompanying drawings. In the present embodiments, a motor is constructed to have four magnetic field poles all coils of which are connected in parallel.

Figure 1:
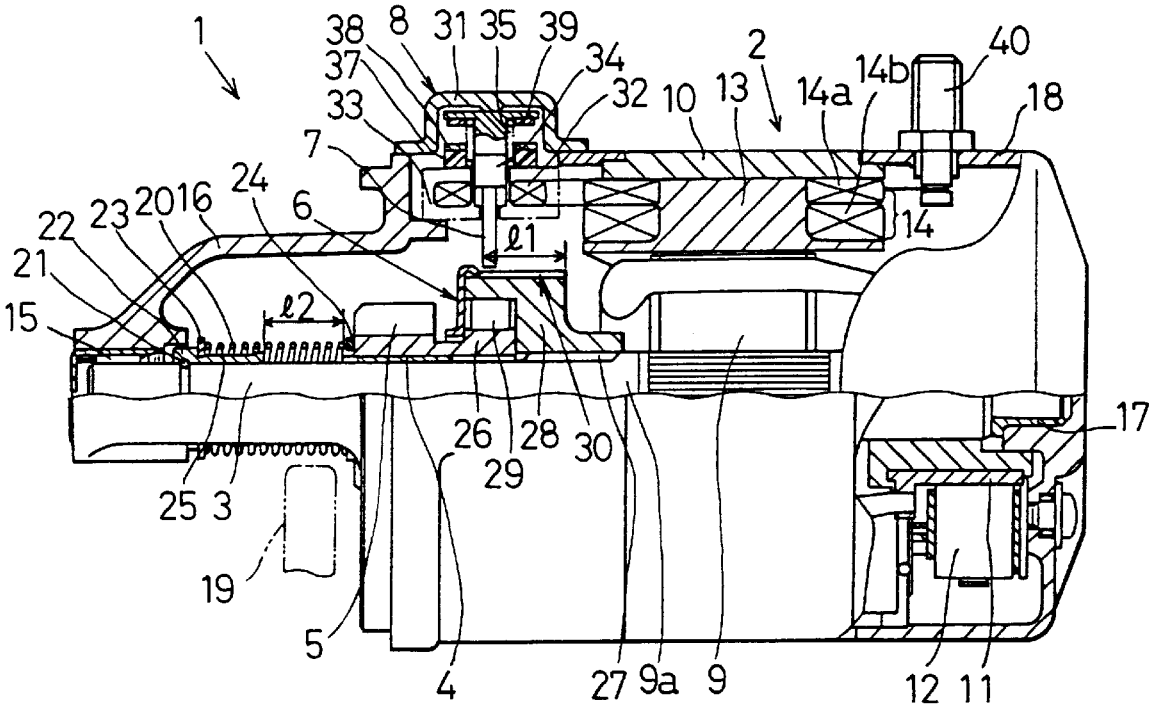
FIG. 1 is a cross-sectional view of a starter according to an embodiment of the present invention.

As shown in FIG. 1, a starter 1 includes a motor 2 for generating rotational force when energized, an output shaft 3 rotated by the motor 2, a pinion 5 rotatably supported through a bearing 4 on the outer periphery of the output shaft 3, a one-way clutch 6 for transmitting the rotational force of the motor 2 to the pinion 5, a rotation restricting member 7 for restricting the rotation of the one-way clutch 6 at the activation of the motor 2, a magnet switch 8 for opening/closing a motor contact disposed in an electric current circuit of the motor 2 and for driving the rotation restricting member 7 upon energization of the motor 2.

The motor 2 includes an armature 9 with an armature coil, a field unit disposed around an outer periphery of the armature 9, a cylindrical yoke 10 for covering the outer periphery of the field unit, brushes 12 (a positive side brush 12*a* and a negative side brush 12*b*) slidable on a commutator 11 formed at a rear end portion of the armature 9, and the like.

Figure 4:
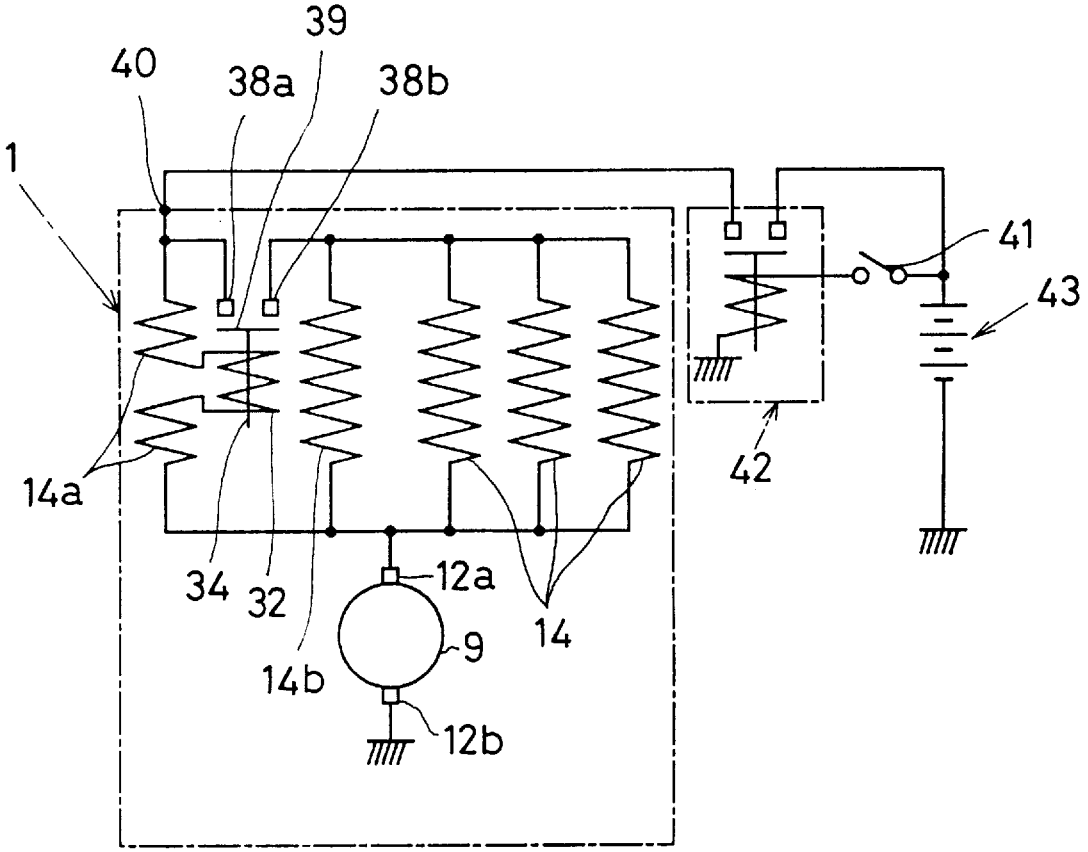
FIG. 4 is an electric current circuit diagram of the starter.
Figure 5:
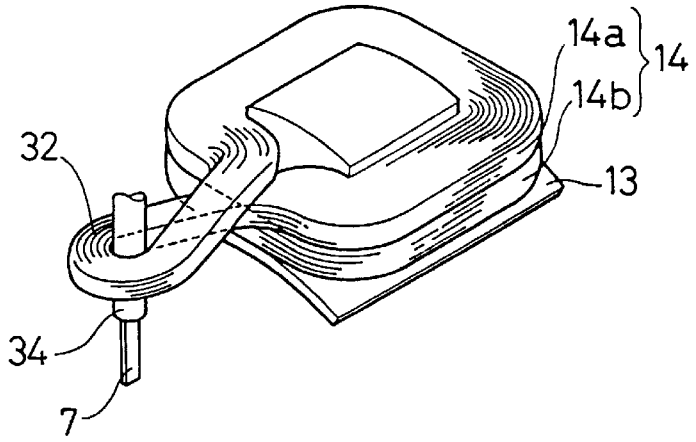
FIG. 5 is a perspective view illustrating a connecting state between a first field coil for a motor and an exciting coil for a magnet switch.
Figure 6:
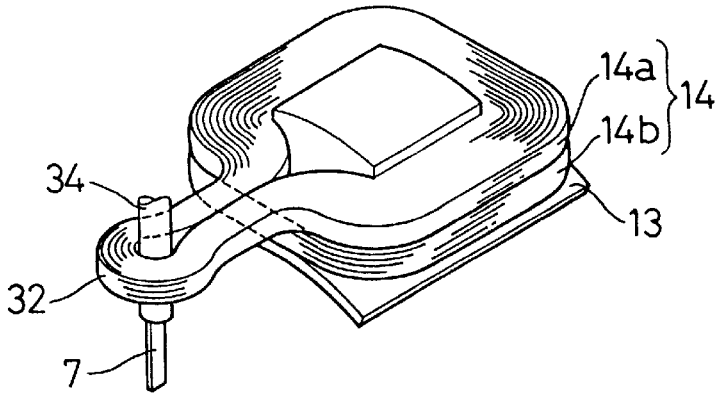
FIG. 6. is a perspective view illustrating another connecting state between the first field coil and the exciting coil.

The field unit includes a pole core 13 fixed at an inner peripheral surface of the yoke 10 and field coils 14 wound around the pole core 13. As shown in FIGS. 4 through 6, one of four field coils 14 has a first field coil 14*a* and a second field coil 14*b* connected in parallel and overlapped with each other in a radial direction, and is wound around the pole core 13. The two-layered coils 14*a* and 14*b*, in combination, are set to generate the same magnitude of magnetic field as each of the other three field coils.

The output shaft 3 is integral with a shaft 9*a* of the armature 9 and an axial front portion thereof is rotatably supported by a housing 16 through a bearing 15. An axial rear end portion of the armature shaft 9*a* is rotatably supported by an end cover 18 through a bearing 17.

A pinion 5 is formed to be engageable with the ring gear 19 by engaging teeth of the pinion 5 with teeth of the ring gear 19 of an engine when moved forward (toward left in FIG. 1) together with the one-way clutch 6 on the output shaft 3. The pinion 5 is normally biased backward (toward the motor 2) by a compression coil spring 20 which is located ahead of the pinion 5 and disposed around the outer periphery of the output shaft 3. The spring 20 is provided between a washer 23 disposed rotatably on a stopper collar 22 fixed on the output shaft 3 through a snap ring 21 and a washer 24 provided rotatably on an axial front end face of the pinion 5. A stopper 25 is integrally formed with the stopper collar 22 to restrict a maximum movable position of the pinion 5 when moved forward along the output shaft 3. The spring 20 can be prevented from being crushed by restricting the maximum movable position of the pinion 5 when the pinion 5 contacts the stopper 25.

Figure 3:
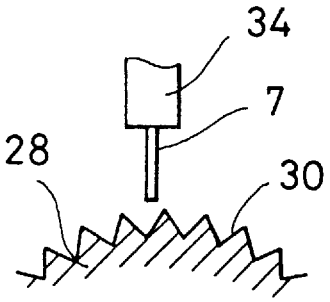
FIG. 3 is a side view illustrating a relation between an engaging groove and a rotation restricting shaft.

The one-way clutch 6 includes an inner ring portion 26 integrally formed with the pinion 5, an outer ring portion 28 engaged with the outer periphery of the armature shaft 9*a* through a helical spline 27, rollers 29 disposed between the inner portion 26 and the outer portion 28 to transmit a rotation of the outer portion 28 to the inner portion 26, and the like. As shown in FIG. 3, at the outer peripheral surface of the outer portion 28, axially extending engaging grooves 30 are formed. The one-way clutch 6 can transmit the rotational force of the outer portion 28 to the inner portion 26 by engaging the outer portion 28 and the inner portion 26 through the rollers 29 when the outer portion 28 rotates by receiving the rotational force of the armature 9. When the pinion 5 engaged with the ring gear 19 rotates by receiving the rotational force of the engine, since the rotational speed of the inner portion 26 is higher than that of the outer portion 28, the roller 29 separates or disengages the outer portion 28 from the inner portion 26 to prevent the armature 9 from overrunning. The pinion 5 and the one-way clutch 6 jointly forms a pinion transmittal body.

The magnet switch 8 includes a switch cover 31, an exciting coil 32, a fixed iron core 33, a plunger 34, a return spring 35, a motor contact and the like. The magnet switch 8 is disposed so that the plunger 34 moves in a radial direction at the outer periphery of the one-way clutch 6.

The switch cover 31 is formed in a cup shape by a press processing and is fixed on the housing 16 via screws (not shown) or the like. The exciting coil 32 is protruded from a portion of the first field coil 14*a* of the motor 2 and is formed as a coil having an axial center which is different from that of the pole core 13 as shown in FIGS. 5 or 6. In FIG. 5 the first field coil 14*a* and the exciting coil 32 are formed in a shape of a number "8", while in FIG. 6 in which the first field coil 14*a* and the exciting coil 32 are formed in a gourd shape. The fixed iron core 33 holds the exciting coil 32 and forms a magnetic path of the exciting coil 32 together with the plunger 34. The plunger 34 is disposed to be movable in an inside space of the exciting coil 32 and attracted to a downward side in FIG. 1 by the magnetic force generated by the exciting coil 32. The return spring 35 is disposed between a motor contact supporting portion of the plunger 34 and the fixed iron core 33 to bias the plunger 34 upwardly, i.e., radially outwardly, in FIG. 1.

Figure 2:
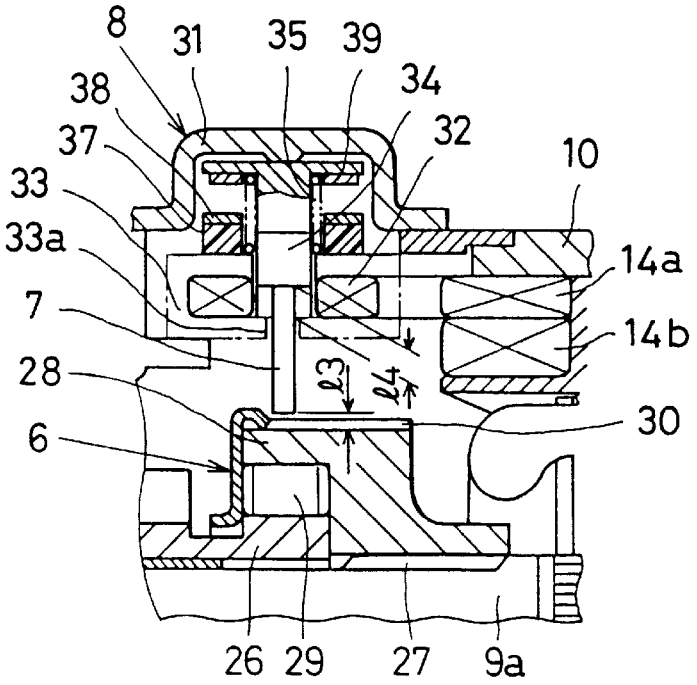
FIG. 2 is an enlarged cross-sectional view illustrating a main portion of the starter.

As shown in FIG. 2 in detail, the motor contact includes a pair of fixed contacts 38 (38*a* and 38*b* in FIG. 4) disposed at the fixed iron core 33 through an insulator 37 and a movable contact 39 disposed at the end portion of the plunger 34 to face the fixed contact 38. When the plunger 34 is attracted toward the one-way clutch 6 by energizing the exciting coil 32, the movable contact 39 moves with the plunger 34 and contacts each of the fixed contacts 38 to conduct the fixed contact 38*a* and the fixed contact 38*b*. As shown in FIG. 4, the fixed contact 38*a* is connected to a battery terminal 40 (FIG. 1) fixed at the end cover 18 and one end of the first field coil 14*a*, while the fixed contact 38*b* is connected to one end of the second field coil 14*b*. The other end of the second field coil 14*b* is connected to the positive side brush 12*a*. The battery terminal 40 is supplied with electricity from a battery 43 through a relay 42 when the starter switch 41 is closed.

The electric current circuit of the motor 2 includes the first current path in which the electric current flows in the armature 9 through the first field coil 14*a* and the exciting coil 32, and the second current path in which the electric current flows in the armature 9 through the second field coil 14*b* when the motor contact is closed with the movement of the plunger 34.

The rotation restricting member 7 is, for example, made of a resilient body such as a leaf spring. As shown in FIG. 2, the rotation restricting member 7 is connected to the bottom of the plunger 34 and passes through an insertion hole 33*a* formed in the fixed iron core 33 and the free end of the rotation restricting member 7 extends to the vicinity of the outer peripheral surface of the outer portion 28. A length $l1$ is provided between the leftmost face of the rotation restricting member 7 and the right side end face of the outer portion 28, and a length $l2$ is provided between the front (leftmost) face of the pinion 5 and the rightmost face of the stopper 25. The relation thereof is $l1<l2$. A radial distance $l3$ is provided from the end of the rotation restricting member 7 to a groove base of the engaging groove 30 formed on the outer peripheral surface of the outer portion 28, and a maximum distance (air gap) $l4$ is provided by which the plunger 34 can move when the exciting coil 32 is energized. The relation thereof is $l3<l4$. It is to be noted that the movable contact 39 contacts the fixed contact 38 when the air gap $l4$ is reduced to zero.

An operation of the present embodiment is explained next.

When the starter switch 41 is closed, the battery 43 supplies electricity to the battery terminal 40 through the relay 42 and the armature 9 is energized only through the first field coil 14*a* of the motor 2 and the exciting coil 32 of the magnet switch 8. At that time, the armature 9 starts to rotate at a low speed due to a weak magnetic field produced by the first field coil 14*a*.

When the plunger 34 is attracted toward the one-way clutch 6 by the magnetomotive force generated by the exciting coil 32, the free end of the rotation restricting member 7 moving integrally with the plunger 34 engages one of the engaging grooves 30 to restrict rotation of the outer portion 28. Therefore, since the rotational force of the armature 9 is transmitted through the helical spline 27 while the rotation of the one-way clutch 6 is restricted by the rotation restricting member 7, the one-way clutch 6 and the pinion 5 move forward against the biasing force of the spring 20 on the output shaft 3 along the helical spline 27.

When the pinion 5 together with the one-way clutch 6 moves forward to a side of the ring gear 19 while the rotation of the pinion 5 is restricted by the rotation restricting member 7, it may happen that the pinion 5 cannot engage the ring gear 19 by just abutting the side face of the ring gear. In this case, since the one-way clutch 6 and the pinion 5 cannot move forward further, the rotation restricting member 7 bends by the rotational force of the armature 9. Therefore, the one-way clutch 6 is allowed to rotate with the bending of the rotation restricting member 7, and the pinion 5 rotating integrally with the one-way clutch 6 can engage the ring gear 19 by turning one pitch of the teeth to an appropriate position for engagement with the ring gear 19.

When the teeth of the pinion 5 engage the teeth of the ring gear 19, the pinion 5 moves forward still more until stopped by the stopper 25. The pinion 5 thus completely engages the ring gear 19. At this point, from the relation of the length l1<the length l2, the rotation restricting member 7 is separated from the engaging groove 30 of the outer portion 28, and the plunger 34 receiving the attraction force is attracted until the air gap l4 is reduced to zero. Thus, the rotation restricting member 7 drops in the right side end surface of the outer portion 28 in the motor side. As the pinion 5 moves forward and engages the ring gear 19, the biasing force of the spring 20 acting on the pinion 5 increments and the pinion 5 receives the rotational force from the engine through the ring gear 19. Thus, the pinion 5 is likely to be pushed rearwardly. However, with the rotation restricting member 7 dropped behind the outer portion 28 in the motor side, a reversing movement of the pinion 5 can be prevented while the pinion 5 is in engagement with the ring gear 19.

When the plunger 34 is attracted until the air gap is reduced to zero, the movable contact 39 contacts the fixed contact 38 to conduct the fixed contacts 38*a* and 38*b*. Therefore, the second field coil 14*b* and the other three field coils 14 together with the first field coil 14*a* are energized. Thus, the rotational force necessary for activating the engine by the large magnetomotive force can be generated by all of the field coils 14 including the first field coil 14*a* and the second field coil 14*b*. Since the high rotational force of the motor 2 is transmitted to the pinion 5 through the one-way clutch 6, the ring gear 19 engaging the pinion 5 rotates at a high speed to start the engine.

After the engine is started successfully and the starter switch 41 is opened (OFF) to shut off supply of electricity to the battery terminal 40, the electric supply to all the field coils 14 including the first field coil 14*a* and the second field coil 14*b* and to the exciting coil 32 is stopped, and the magnetic force from each of the coils 14*a*, 14*b*, 14 and 32 is extinguished. Therefore, the rotational force of the armature 9 disappears and the plunger 34 returns to the initial position by the return spring 35. The rotation restricting member 7 is separated from the right side end face of the outer portion 28 in the motor side and returns to the initial position. As a result, the pinion 5 and the one-way clutch 6 which are prevented from reversing by the rotation restricting member 7 are returned to the initial position thereof by the biasing force of the spring 20 and the reversing force of the ring gear 19.

According to the present embodiment, when the starter switch 41 is closed (ON), the electricity only flows in the first field coil 14*a* and the motor 2 is energized by a low magnetomotive force. The motor contact is closed by the operation of the magnet switch 8 and the electricity flows in all of the field coils 14 including the second field coil 14*b* to rotate the motor 2 at a high speed by the full magnetomotive force. Thus, the energization of the motor 2 can be executed in two stages in a simple structure and without using a resistor, the reliability of the motor operation is improved.

The motor contact is maintained open until the rotation restricting member 7 is separated from the engaging groove 30 of the outer portion 28 and drops in the side end face of the outer portion 28 in the motor side after the pinion 5 engages the ring gear 19, and the second field coil 14*b* is not conducted. Therefore, even after the pinion 5 engages the ring gear 19, while the rotation restricting member 7 engages the engaging groove 30 of the outer portion 28, the motor 2 is driven by the low magnetomotive force and rotates at low speed. As a result, the pinion 5 can engage the ring gear 19 without an excessive impact upon engagement, damages to each component (pinion 5, output shaft 3, one-way clutch 6 and the like) and the ring gear 19 can be reduced to a minimum.

In the present embodiment, even when the pinion 5 contacts but and does not engage the ring gear 19, the rotation restricting member 7 bends by the rotational force of the armature 9, and the one-way clutch 6 and the pinion 5 can rotate by an amount the rotation restricting member 7 bends. Therefore, while the pinion 5 rotates by at least one pitch of the teeth, the pinion 5 reaches an appropriate position for engagement with the ring gear 19, and the pinion 5 can engage the ring gear 19 when the teeth of the two engage with each other. As a result, failure in engagement between the pinion 5 and the ring gear 19 can be prevented.

Figure 7:
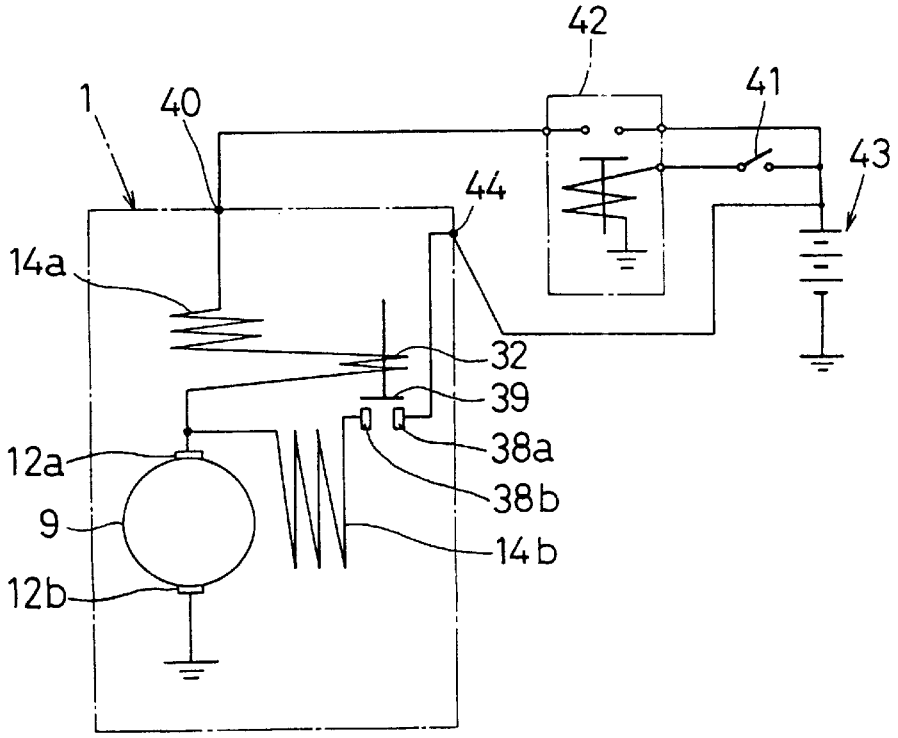
FIG. 7 is a modified current circuit diagram of the starter according to another embodiment of the present invention.

As a modified embodiment (FIG. 7), in place of connecting the first field coil 14*a* and the fixed contact 38*a* to the battery terminal 40, only the first field coil 14*a* may be connected to the battery terminal 40 and the fixed contact 38*a* may be connected to another terminal 44 connected directly to the battery 43.

Further, in place of bending the rotation restricting member 7 in the rotational direction, an engaging member having an outer peripheral surface on which engaging grooves are formed may be made of a resilient body and fixed to the outer periphery of the outer portion. In this case, even though the rotation restricting member is made of a rigid body, the engaging member can be deformed (bent) in the rotational direction by the rigid restricting member, and the pinion can engage the ring gear.

In place of restricting the rotation of the one-way clutch in the pinion transmittal body (pinion is integrated with one-way clutch), the pinion can be separated from the one-way clutch and the rotation of the pinion as the pinion transmittal body can be restricted.

Further, in place of using four-pole magnetic field and the four poles connected in parallel in the motor, any number of poles other than four may be provided, and all of the field coils need not be connected in parallel.

The present invention having been described should not be limited to the disclosed embodiments, but it may be modified in many other ways without departing from the scope and the spirit of the invention. Such changes and modifications are to be understood as being included with the scope of the present invention as defined by the appended claims.

What is claimed is:

1. A starter comprising:

a motor having a field coil including first and second field coils connected in parallel;

an output shaft rotatable by the motor;

a pinion transmittal body fitted on the output shaft through a helical spline and having at a front end side thereof a pinion engageable with a ring gear of an engine, the pinion transmittal body being movable on the output shaft along the helical spline to the ring gear in response to a rotation of the motor while being restricted in rotation;

rotation restricting means for restricting the rotation of the pinion transmittal body; and a magnet switch having an exciting coil connected to the first field coil, the magnet switch being for driving the rotation restricting means by pulling a plunger by magnetomotive force generated by the exciting coil, the exciting coil being formed with a portion of a winding conductor of the first field coil, the magnet switch being for releasing the restriction of the rotation of the pinion transmittal body and closing a motor contact provided in an electric current circuit of the motor when the pinion transmittal body moves a predetermined distance.

2. A starter according to claim 1, wherein the exciting coil is connected to the first field coil in series.

3. A starter according to claim 1, wherein the exciting coil is connected to the first field coil in parallel.

4. A starter according to claim 1, wherein the rotation restricting means is made of a resilient body to rotate the pinion movable body by deforming.

5. A starter according to claim 1, wherein the rotation restricting means is constructed to drop behind the pinion transmittal body to enable rotation of the pinion transmittal body and to prevent a reversing motion of the pinion transmittal body while engaging the ring gear.

6. A starter for starting an engine having a ring gear, comprising:

a motor having a field coil unit and an armature rotatable upon energization;

an output shaft rotatable by the motor;

a pinion transmittal body having a pinion mounted on the output shaft through a helical spline connection, the pinion being rotatable with the output shaft when allowed to rotate and axially movable along the output shaft when restricted to rotate;

a restriction member engageable with the pinion transmittal body for restricting a rotation of the pinion; and a magnet switch having a motor contact and an exciting coil connected in circuit with the armature, the exciting coil being formed with a portion of a winding conductor of the field coil unit, the magnet switch being constricted to drive the restriction member for an engagement with the pinion transmittal body so that the pinion moves axially toward the ring gear and to supply a low electric voltage to the armature for a low speed rotation upon a start of energization of the exciting coil, and the magnet switch being further constructed to drive the restriction member further for a disengagement from the pinion transmittal body so that the pinion rotates with the output shaft for driving the ring gear and to supply a high electric voltage through the motor contact to the armature for a high speed rotation after the engagement of the pinion with the ring gear.

7. A starter according to claim 6, wherein the field coil unit includes:

a first field coil connected in series with the armature; and a second field coil connected in series with the armature and in parallel with the first field coil through the motor contact.

8. A starter according to claim 7, wherein the exciting coil of the magnet switch is connected in series with the first field coil of the motor.

* * * * *